United States Patent [19]

Froebe et al.

[11] Patent Number: 4,810,994

[45] Date of Patent: Mar. 7, 1989

[54] SPIRAL WIRE CONTACT ASSEMBLY FOR VARIABLE RESISTOR

[75] Inventors: Ronald L. Froebe, Rubidoux; Jesus Duarte, Lake Elsinore; Richard L. Bailey, Riverside, all of Calif.

[73] Assignee: Bourns, Inc., Riverside, Calif.

[21] Appl. No.: 859,098

[22] Filed: May 2, 1986

[51] Int. Cl.[4] ..... H01C 1/012

[52] U.S. Cl. ..... 338/202; 338/162; 338/167

[58] Field of Search ..... 338/171, 167, 141, 147, 338/170, 202, 162, 174, 207, 197; 200/252, 276, 11 D

[56] References Cited

U.S. PATENT DOCUMENTS

| | | | |
|---|---|---|---|
| 2,745,915 | 5/1956 | Pantages | 200/11 |
| 2,796,501 | 6/1957 | Daily | 338/170 |
| 2,956,254 | 10/1960 | Burns et al. | 338/162 |
| 3,168,719 | 2/1965 | Bemmann et al. | 338/165 |
| 3,324,440 | 6/1967 | Strief et al. | 338/162 |
| 3,704,436 | 11/1972 | Froebe et al. | 338/202 |
| 4,184,140 | 1/1980 | Frey, Jr. et al. | 338/174 |
| 4,186,483 | 2/1980 | Laube et al. | 29/630 B |
| 4,427,966 | 1/1984 | Gratzinger et al. | 338/162 |
| 4,492,838 | 1/1985 | Fukukura | 200/276 |

FOREIGN PATENT DOCUMENTS

| | | | |
|---|---|---|---|
| 560809 | 11/1929 | Fed. Rep. of Germany | 200/276 |

*Primary Examiner*—E. A. Goldberg
*Assistant Examiner*—M. Lateef
*Attorney, Agent, or Firm*—Howard J. Klein; William G. Becker

[57] ABSTRACT

A contact for a rotary action variable resistor is formed of a length of wire coiled into a flattened, substantially annular spiral, with a wiper element provided by a radial protuberance on the spiral. A first embodiment has a protuberance along each of a first pair of diametrically-opposed radii. The spiral is eccentrically mounted on a substantially circular support plate, with one protuberance extending close to the peripheral edge thereof, and the other protuberance closer to the center of the plate. The spiral is attached to the plate along a second pair of diametrically-opposed radii approximately 90 degrees displaced from the first pair. The spiral is sloped so that the distance between the plate and the spiral gradually increases from the attachment radii to the protuberances. The protuberance near the edge of the plate is a resistive element wiper, and the protuberance nearer the center is the collector wiper. In a second embodiment, the spiral is mounted approximately concentrically on the plate, with a single radial protuberance. The spiral is attached to the plate along a line that defines a chord that is substantially perpendicular to the protuberance, and at least 90 degrees displaced from the therefrom. The spiral is sloped so that the distance between the plate and the spiral gradually increases from the attachment chord to the protuberance. The protuberance is the resistive element wiper, while the collector wiper function is provided by a conductive element preferably formed as part of the plate.

32 Claims, 3 Drawing Sheets

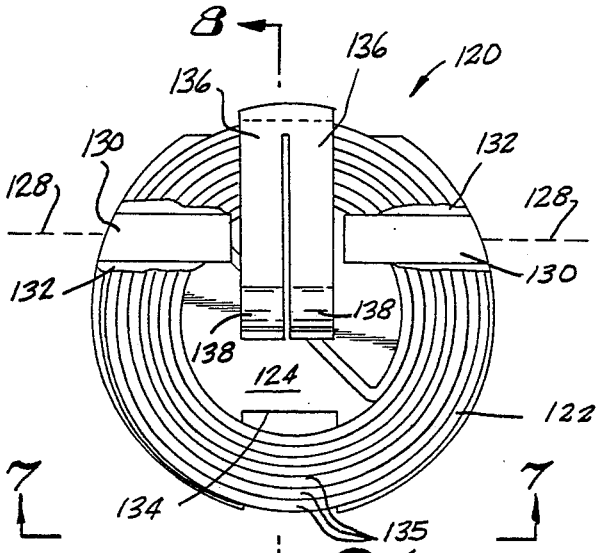
FIG. 6.
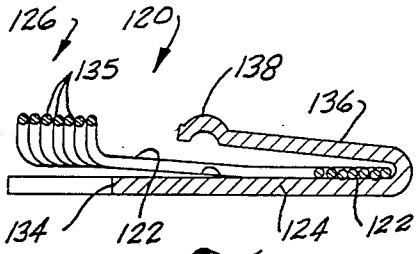
FIG. 8.
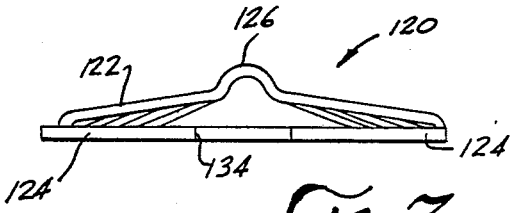
FIG. 7.
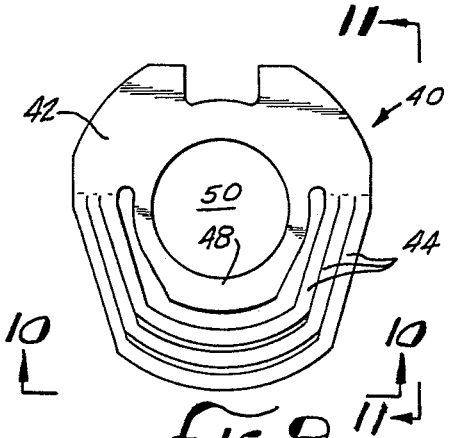
FIG. 9.
PRIOR ART
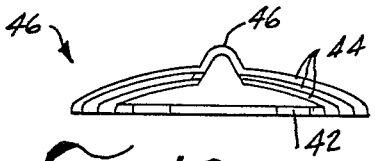
FIG. 10. PRIOR ART
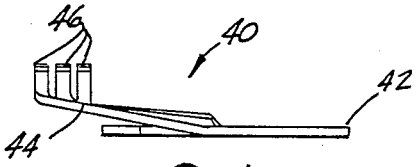
PRIOR ART FIG. 11.

SPIRAL WIRE CONTACT ASSEMBLY FOR VARIABLE RESISTOR

BACKGROUND OF THE INVENTION

The present invention relates broadly to the class of electrical components encompassing variable resistive devices (i.e., rheostats and potentiometers). More particularly, it relates to a contact assembly particularly adapted for a rotary potentiometer having a resistive element formed of a thick or thin film composition, such as cermet, conductive plastic or metal deposition, but which may also be adapted for a device with a wire-wound resistive element.

Miniature, single-turn, rotary potentiometers typically employ a resistive element that is formed on a substrate in a substantially annular configuration, and concentrically surrounding a central conductive collector. Electrical contact is established between the collector and a selectable position on the resistive element by means of a contact mounted on a rotor. A common type of contact in such potentiometers comprises a multi-wire spring contact, cantilever-mounted on the rotor so as to brush against, or "wipe" the resistive element as the rotor is turned. Examples of this type of contact are disclosed in U.S. Pat. No. 3,704,436 to Froebe et al.; U.S. Pat. No. 4,186,483 to Laube et al.; and U.S. Pat. No. 4,427,966 to Gratzinger et al., all commonly assigned to the assignee of the subject application.

A representative example of such a prior art multi-wire contact is shown in FIGS. 15 and 16 of the present disclosure. These figures show a multi-wire contact 10, of the cantilever type, comprising an array of wires in side-by-side relationship, forming a flat, rotor-mounted body portion 12, and an unsupported portion which is bent to form a plurality of resilient, cantilevered contact fingers 14, each with a protuberance 16 near its free end to provide a contact point 16. As shown in FIG. 16, the contact may be split into two sets of fingers 14 separated by a gap 18. The larger set of fingers 14 wipes or brushes against a resistive element 20 on the substrate 22 of a potentiometer 24 (FIG. 12), while the smaller set contacts a central conductor or collector element 26. Advantageously, the fingers at the outer margins of each set are of broader cross-section than the inner fingers, as shown in FIG. 16, to form bracing fingers 28 that minimize the side-to-side movement ("chattering") of the fingers as they traverse the resistive element 20, while also minimizing any lateral spreading between the fingers 14.

Multi-wire contacts, of the type described above, exhibit low contact resistance and low contact resistance variation (CRV). Nevertheless, this type of contact still poses some problems. For example, as shown by the broken outline in FIG. 12, the contact 10 is oriented transversely in the potentiometer 24 so that its contact points 16 are substantially aligned with the radius of curvature of the resistive element 20, describing a path that is substantially tangential thereto as the contact is rotated. This orientation requires the contact 10 to occupy space within the potentiometer that must be accommodated by a clearance on the substrate 22 beyond the outer radius of the resistive element 20, thereby both wasting space on the substrate and limiting the radius of the contact's path. The result is a shorter resistive element length than might otherwise be accommodated on a given area of substrate. If the substrate area is to be kept within a specific limit due to physical constraints imposed by the application of the potentiometer, the resulting limitation on the length of the resistive element may lead to poor resolution, stability, settability, and heat dissipation, and increased contact resistance and CRV. Conversely, if the operational parameters of the component are optimized, its physical dimensions may have to be increased, thereby possibly limiting its range of applications. In short, the typical cantilever-type contact geometry requires a trade-off between size and performance, particularly in the exhibited CRV.

Another drawback to the cantilevered multi-wire contact is the display of "voltage ratio shift" (VRS), as a result of wear on the contact points 16, as illustrated in FIGS. 17*a*, 17*b*, and 17*c*. In those figures, it can be seen that as the contacts wear, a flat spot or "footprint" 32, of gradually increasing size, develops on the underside of the contact points 16. (The relative size of the footprint 32 shown in the drawings is exaggerated for clarity). The development of a significant footprint 32 produces what is known as "heel-and-toe" effect, which is a shift of the specific point of contact between the resistance element 20 and the contact element 10 as a result of even minute changes in the axial loading applied to the rotor and the contact element. For example, FIG. 17*b* illustrates the nominal position of the contact element 10 with respect to the resistance element. A small increase in the load placed on the contact element (FIG. 17*a*), or a slight decrease in the loading (FIG. 17*c*) shifts the point of contact away from its nominal position. This shifting contact point, in turn, produces the VRS effect.

Still another problem with the prior art multi-wire contact 10 is the aforementioned "chattering" effect. Although this effect is reduced by the bracing fingers 28 (FIG. 16), there is still some side-to-side displacement of the contact fingers as indicated by the broken outline 34 in FIG. 16. Like the "heel-and-toe" effect, the chattering results in an increase in VRS, and it can also produce changes in the resistance setting. A related problem is that of the spreading or splaying of the fingers 14, again minimized, but not eliminated, by the bracing fingers 28. This, too, can result in degraded performance characteristics.

In an attempt to overcome these problems with the multi-wire contact, a single conductor contact has been devised, as shown in FIGS. 9, 10, and 11. This single conductor contact, indicated by the numeral 40, comprises a substantially annular metal stamping having a solid portion or base 42 that is attached to the rotor of a rotary-action variable resistive device. A substantial portion (about one-half to two-thirds) of the circumference of the stamping is divided by arcuate cuts into a plurality of substantially concentric arcuate contact elements 44. These contact elements 44 are raised out of the plane of the base portion 42, as shown in FIGS. 10 and 11, and each of them has a "hump" or protuberance 46 at the midpoint of its arc length. These protuberances 46 provide the contact points that brush or wipe against the resistive element. In some applications, an inner contact element 48, adjacent the central aperture 50 of the stamped contact 40, may function as a collector contact. Most applications, however, where the stamped contact 40 is used, are of the so-called "hot rotor" design where the rotor itself (not shown in the drawing in connection with the stamped contact 40)

extends through the aperture 50 and establishes electrical contact with the collector.

An advantage of the stamped, single conductor contact 40 is that it is not as prone to chattering or splaying as the multi-wire contact 10. Moreover, its annular configuration allows a more efficient use of space within the potentiometer, requiring less clearance around the outside of the resistive element, and thereby allowing a longer resistive element to be used. This is illustrated in FIG. 14, where a potentiometer 24', having a substrate 22', includes an annular contact that is indicated diagramatically by the broken circle 52. It can be seen that the potentiometer 24' can be provided with a much longer resistive element 20', as compared with the resistive element 20 used with the multi-wire contact 10. (See FIG. 12.) This arrangement thus overcomes the previously-discussed disadvantages associated with the cramped resistive element configuration shown in FIG. 12.

In addition, the stamped contact 40 is less likely to exhibit VRS as a result of the previously-discussed "heel-and-toe" effect. This, along with the aforementioned reduction in "chattering", gives the stamped contact 40 very favorable VRS characteristics as compared to the multi-wire contact 10.

Furthermore, the concentric contact elements 44 of the stamped contact provide a longer spring arm than do the fingers 14 of the multi-wire contact 10. This allows the use of a lower spring rate which, in turn, results in a lower probability of the contact taking a "set" under load, with a resultant possible degredation of contact performance characteristics when the load is varied.

Nevertheless, the stamped contact 40 typically exhibits higher contact resistance and CRV than does the multi-wire contact 10, due to the smaller number of discrete contact elements 44 compared to the number of contact fingers 14 employed in the multi-wire contact. Limitations in manufacturing techniques for the stamped contact 40 simply do not allow the fabrication of contact elements 44 that are as narrow as the thin wires used in the multi-wire contact.

Thus, it can be seen that there has been a long-felt, but as yet unsatisfied need, for a contact assembly for a rotary-action variable resistor that combines the aforementioned advantages of both the multi-wire contact and the single conductor stamped contact, and yet which avoids or minimizes the disadvantages associated with each of these designs.

SUMMARY OF THE INVENTION

Broadly, the present invention is a contact for a rotary-action variable resistor (i.e., a rheostat or a potentiometer) wherein the contact comprises a length of conductor coiled into a flattened, substantially annular spiral, with a wiper element provided by a protuberance along a selected radius of the spiral.

More specifically, in a first preferred embodiment, the contact is formed from a length of wire that is coiled into an annular spiral, with a pair of wiper elements provided by a protuberance along each of a first pair of diametrically-opposed radii. The spiral is eccentrically mounted on the flat surface of a substantially circular support plate, such that one protuberance extends approximately to the peripheral edge of the rotor to which the plate is attached, while the other protuberance has a portion that is close to, or substantially concentric with, the center of the rotor. The spiral is attached to the plate along a second pair of diametrically-opposed radii that are approximately 90 degrees displaced from the first pair. A resilient spring effect is achieved by bending or sloping the spiral outwardly from its attachment radii, so that the distance between the plate and the spiral gradually increases from the attachment radii to the protuberances. In this embodiment, the plate is mounted on the rotor so that the protuberance adjacent to the peripheral edge of the rotor functions as the resistive element wiper, while the protuberance that is closer to the center of the rotor functions as the collector wiper.

In a second preferred embodiment, the coiled-wire spiral is mounted concentrically or nearly concentrically on a substantially circular support plate, with only a single protuberance being formed along a selected radius of the spiral. In this second embodiment, the spiral is attached to the plate along a line that defines a chord across the spiral that is substantially perpendicular to the radius on which the protuberance is formed, the chord being circumferentially displaced from the protuberance by at least about 90 degrees on either side of the protuberance. The attachment chord, in other words, is no closer to the protuberance than the diameter of the spiral. As in the first embodiment, a resilient spring effect is achieved by bending or sloping the spiral outwardly from its attachment chord, so that the distance between the plate and the spiral gradually increases from the attachment chord to the protuberance. In this embodiment, the protuberance on the spiral functions as the resistance element wiper, while the collector wiper function is provided by a collector contact element attached to, or formed integrally with, the support plate. A preferred construction for the collector contact element is one or more fingers extending from the edge of the plate diametrically opposite the protuberance, and bent radially inwardly over the spiral. The fingers each terminate in a contact button which is positioned to ride on the collector path of the resistive device.

Both of the preferred embodiments of the invention exhibit the heretofore unachieved advantages sought in multi-wire contacts. Specifically, the annular geometry of the contact in accordance with the present invention allows a more efficient use of space than the cantilevered multi-wire contact described above. In particular, the annular contact geometry does not require as much clearance on the rotor beyond the outside radius of the resistive element, thereby allowing the use of a longer resistive element and a wiper path radius that may even be somewhat larger than the radius of the rotor. Thus, for a substrate of a given dimension, a longer resistive element can be used, with improved resolution, stability, settability, and heat dissipation. In addition, contact resistance and CRV are maintained at the low levels associated with mult-wire contacts, with measurable improvement in these parameters having been achieved in experimental prototypes of the present invention. Thus, the present invention requires no trade-off between size and performance, allowing performance characteristics to be optimized in the minimum amount of packaging space.

Moreover, it has been found in experimental prototypes of the invention that VRS is significantly reduced as compared with prior art multi-wire contacts, due to a marked reduction in the heel-and-toe effect. Furthermore, the advantages of prior art split wipers are achieved without the "chattering" previously associated with the split wiper, thereby also contributing to the lower measured VRS.

In addition, contacts constructed in accordance with the present invention suffer little or none of the "splaying" to which prior art multi-wire contacts may be prone. Thus, the present invention achieves degrees of stability and durability approaching those of the annular, stamped-conductor type of contact. Also, in both of the preferred embodiments of the present invention, the attachment of the contact to the rotor provides a more nearly balanced loading on the rotor, as compared with the cantilevered, multi-wire contact, with a resultant reduction in the amount of stress at the points of attachment. The likelihood of degraded performance or failure due to such stresses is thus significantly reduced.

Still another advantage that results from the annular geometry of the present invention is that of a more uniform distribution of wear among the several contact points. This result is due to lower spring rates of the radially outermost contact points, which travel a longer path, as compared with the radially innermost contact points, which travel a shorter path. This inverse relationship between path length and spring rate allows the contact points which undergo the most travel to be subjected to a lower force against the resistance element, while those with the shorter path suffer a greater force, resulting in more uniform wear.

As will be better appreciated from the detailed description which follows, these advantages and others are achieved with a contact structure that is both simple and economical to fabricate.

BRIEF DESCRIPTION OF THE DRAWINGS

FIG. 6 is a plan view of a contact assembly in accordance with a second preferred embodiment of the present invention;

FIG. 7 is an elevational view taken along line 7—7 of FIG. 6;

FIG. 8 is a cross-sectional view taken along line 8—8 of FIG. 6;

FIG. 9 is a plan view of one type of prior art contact, as discussed and described previously herein;

FIG. 10 is an elevational view taken along line 10—10 of FIG. 9;

FIG. 11 is an elevational view taken along line 11—11 of FIG. 9;

DETAILED DESCRIPTION OF THE INVENTION

1. Introduction

Figure 1:
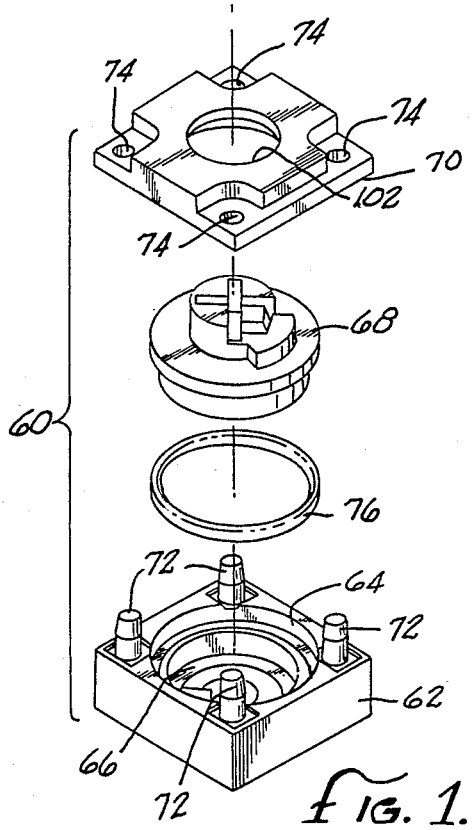
FIG. 1 is an exploded perspective view of a rotary-action potentiometer, of the type in which a contact assembly according to the present invention can be incorporated.
Figure 2:
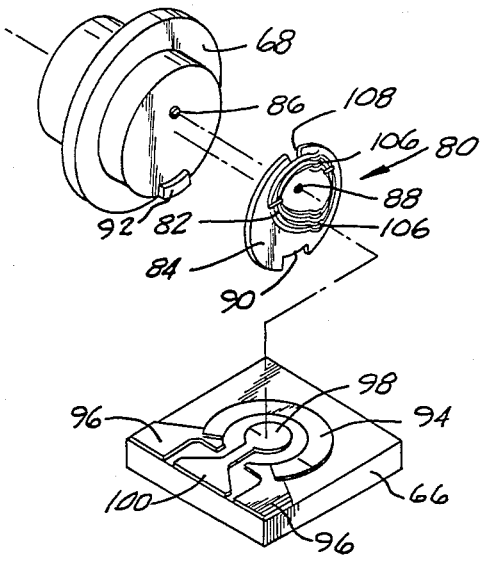
FIG. 2 is an exploded perspective view of the internal mechanism of the potentiometer of FIG. 1, showing a contact assembly in accordance with a first preferred embodiment of the present invention.

Before describing the present invention in detail, it may be helpful to describe a typical rotary-action, variable resistance device, of the type into which the present invention can be incorporated. Such a device is illustrated in FIGS. 1 and 2, and designated generally by the numeral 60. The device 60 may be either a potentiometer or a rheostat, depending upon the connection of its leads. For simplicity in the ensuing description, the device 60 will be referred to as a potentiometer.

The potentiometer 60 comprises a body or housing 62 having a circular cavity or recess 64 in which is seated a substrate 66, the latter being shown more clearly in FIG. 2. A rotor 68 is also seated in the recess 64 so that the planar surface on its underside is facing the substrate 66 in close proximity thereto. The top of the housing 62 is closed with a lid or cover 70 that is heat-staked to the housing 62 by means of a plurality of posts 72 extending from the housing through holes 74 in the lid 70. An 0-ring 76 may optionally be provided within the recess 64 for providing a seal around the rotor 68 against dirt, dust, and the like.

Referring now to FIG. 2, a contact assembly 80 in accordance with a first preferred embodiment of the invention is shown in conjunction with the rotor 68 and the substrate 66 of the potentiometer 60. The contact assembly 80 will be described in more detail below, but for purposes of the present discussion, it will suffice to describe the invention as comprising, basically, a substantially annular conductive contact element 82 fixedly attached to a support plate 84. The support plate 84, in turn, is mounted on the underside of the rotor 68. The attachment of the support plate 84 to the rotor 68 may advantageously be accomplished by means of a post or pin 86 on the underside of the rotor 68 which passes through an aperture 88 in the support plate 84 and is then heat-staked. The support plate 84 also advantageously has a peripheral notch 90 which registers with a stop member 92 on the underside of the rotor 68.

Still referring to FIG. 2, some details of the substrate 66 may be noted. Specifically, a resistive element 94, arcuate in configuration, is provided on the substrate. The resistive element 94 is typically formed of a thick film or a thin film composition, such as cermet, conductive plastic, or metal deposition, as is well-known in the art. Each end of the resistive element terminates in a conductive termination pad 96 which, in turn, is conductively connected to a lead (not shown). A conductive tap or collector element 98 is centrally disposed on the substrate so as to be substantially surrounded by the resistive element. The collector element typically extends to the edge of the substrate, terminating in a collector termination pad 100 that is also conductively connected to a lead (not shown).

When the contact assembly 80 is attached to the rotor 68, and the rotor is installed in the housing as previously described, the contact element 82 is brought to bear against the resistive element and the collector element to provide electrical conduction therebetween. As the rotor 68 is turned, by means of a tool (not shown) inserted through an aperture 102 in the lid 70 (FIG. 1), the contact element establishes an electrical connection between the collector element 98 and different points on the resistive element 94 to provide the potentiometric function.

Having described the context of the present invention, the preferred embodiments may now be described in detail.

2. The First Preferred Embodiment (FIGS. 3, 4, and 5)

Figure 3:
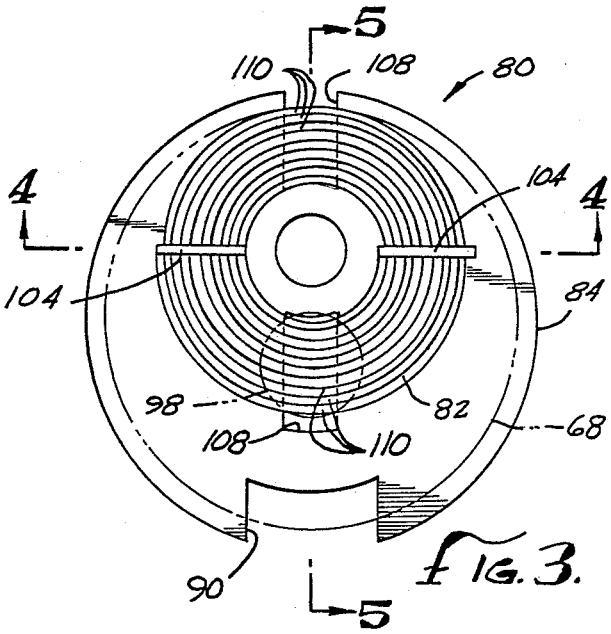
FIG. 3 is a plan view of a contact assembly in accordance with a first preferred embodiment of the present invention.
Figure 5:
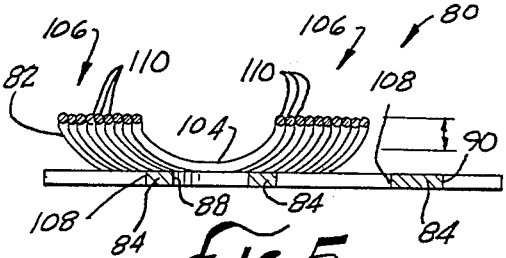
FIG. 5 is a cross-sectional view taken along line 5—5 of FIG. 3.
Figure 4:
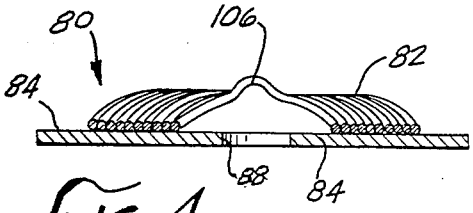
FIG. 4 is a cross-sectional view taken along line 4—4 of FIG. 3.

A contact assembly 80, in accordance with the first preferred embodiment of the invention, is illustrated in detail in FIGS. 3, 4, and 5. As previously mentioned, the contact assembly comprises a conductive contact element 82 fixedly attached to the planar surface of a substantially circular support plate 84. The contact element 82 is a continuous length of conductor, such as a fine gauge wire, coiled into a flattened, substantially annular spiral. Preferably, at least 8 to 10 turns of wire should be used. The spiral is fixed to the support plate 84 along a pair of diametrically-opposed radii 104. The attachment can be by any of several conventional techniques, including soldering and epoxy bonding. A preferred method is to form the support plate with a pair of integral prongs which are bent over the spiral contact element 82 along the radii 104, and then soldered for permanent attachment.

A protuberance 106 is formed in the spiral contact element 82 along each of two radii that preferably define a diameter which is about 90 degrees displaced from the diameter defined by the attachment radii 104. The protuberances 106 extend away from the planar surface of the support plate 84, and are advantageously formed by appropriate tooling, known to those skilled in the pertinent arts, which is applied against the spiral contact element 82 through a pair of slots 108 in the support plate 84. In FIG. 3 it can be seen that the spiral contact element 82 is mounted eccentrically on the support plate 84, whereby one of the protuberances 106 extends close to the peripheral edge of the plate so as to extend approximately to the edge of the rotor 68 (shown in phantom outline in FIG. 3) to which the plate is attached. The other protuberance, accordingly, has a portion that is substantially concentric with the center of the plate 84, and also of the rotor 68 (the plate being mounted approximately concentrically on the rotor).

A resilient spring effect is achieved by bending or sloping the contact element 82 outwardly from its attachment radii 104, so that the distance between the plate 84 and the contact element 82 gradually increases from the attachment radii 104 to the radii along which the protuberances 106 are aligned. The bending can be performed advantageously when the protuberances 106 are formed, by the same, or similar means.

In this embodiment, the plate 84 is mounted on the rotor so that, as mentioned above, one protuberance 106 extends approximately to the edge of the rotor. This "peripheral" protuberance, with its multiplicity of radially-arrayed contact points 110 (one for each turn of wire), functions as a contact or wiper for the resistive element 94. The other protuberance 106, with its contact points 110, is located so as to have a portion that is substantially concentric with the center of the rotor. It thus functions as a wiper for the collector 98, shown in phantom outline in FIG. 3.

Figure 12:
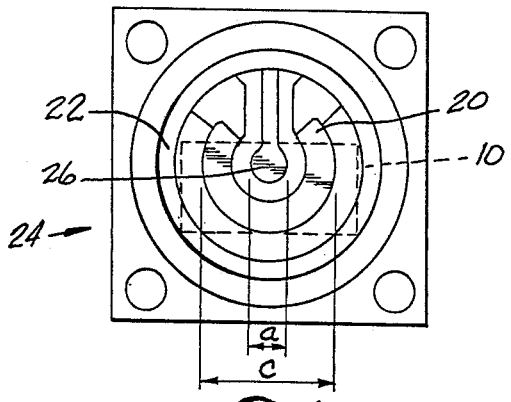
FIG. 12 PRIOR ART
FIGS. 12, 13 and 14 are top plan views of the substrates, resistive elements, and collector elements of rotary-action potentiometers, showing the geometry and dimensions of these elements when different types of contact assemblies are incorporated in the potentiometers.
Figure 13:
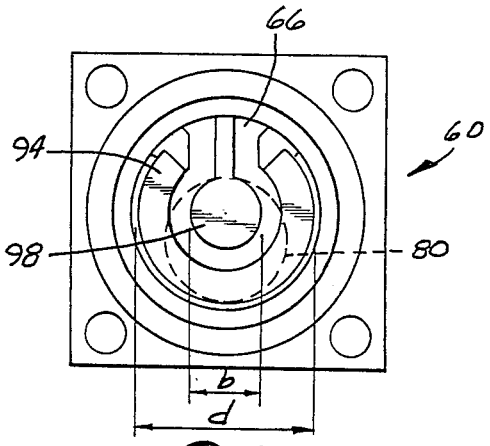
Figure 15:
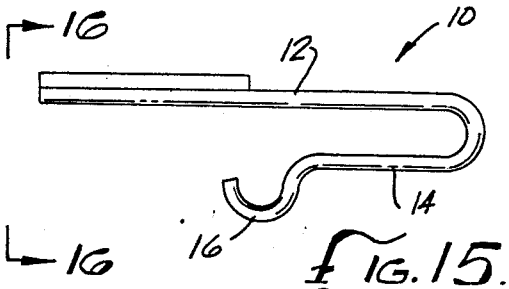
FIG. 15. PRIOR ART
FIG. 15 is an elevational view of another type of prior art contact assembly, as discussed and described previously herein.

One of the principal advantages of the contact assembly 80 is illustrated in FIGS. 12 and 13. FIG. 12, as previously discussed, shows the dimensions of the resistive element and the collector element when the prior art cantilevered multi-wire contact 10 is used, while FIG. 13 shows the dimensions of these elements when the contact assembly 80, in accordance with the first preferred embodiment of the present invention is used. In FIG. 13, the contact assembly 80 is shown as a dashed circle superimposed on the substrate 66. It can be seen that, unlike the embodiment of FIG. 12, little or no clearance space is required around the outside of the resistive element 94. This allows the resistive element 94 to be considerably lengthened, as compared to the resistive element 20 of the prior art device, as can be appreciated from a comparison of the diameter "d" in FIG. 13 to the diameter "c" in FIG. 12. Likewise, the surface area of the collector element 98 used with the present invention is greater than that of the prior art collector element 26, as can be seen by comparing the diameter "b" in FIG. 13 to the diameter "a" in FIG. 12.

The increase in resistive element length allowed by the present invention substantially eliminates the tradeoff between size and performance required by prior art devices. Thus, as previously discussed, the larger resistive element 94 provides improved resolution, stability, settability, and heat dissipation as compared to prior art devices. Furthermore, the good contact resistance and CRV characteristics of prior art multi-wire contacts are retained, and even improved. All of these qualities may be optimized while maintaining compact physical dimensions for the entire potentiometer.

Moreover, the chattering effect and the heel-and-toe effect associated with prior art multi-wire contacts are substantially minimized by the present invention, as is the possibility of splaying between the individual contact points. Accordingly, there is a marked improvement in the VRS characteristics and in stability as compared to prior art multi-wire contacts.

3. The Second Preferred Embodiment (FIGS. 6, 7, and 8)

Another contact assembly 120, in accordance with a second preferred embodiment of the invention, is illustrated in FIGS. 6, 7, and 8. Like the first preferred embodiment described above, the contact assembly 120 comprises a conductive contact element 122 fixedly attached to the planar surface of a substantially circular support plate 124. The contact element 122 is a continuous length of conductor (e.g., a fine gauge wire) coiled into a flattened, substantially annular spiral. Again, at least about 8 to 10 turns of wire are preferably used to form the spiral contact element 122.

In this embodiment, a single protuberance 126 is preferably formed along a selected radius of the contact element 122. The contact element is mounted on the support plate 124 so as to be concentric with the support plate, or nearly so. The contact element 122 is fixedly attached to the support plate 124 along a line that defines a chord 128 across the contact element that is substantially perpendicular to the radius along which the protuberance is formed, the chord 128 being circumferentially displaced from the protuberance 126 by at least about 90 degrees on either side of the protuberance. In other words, the attachment chord 128 is located no closer to the protuberance 126 than the diameter of the spiral contact element 122.

The attachment of the contact element 122 to the support plate 124 can be effected by any means which establishes a good electrical connection therebetween, for purposes which will be made clear below. A preferred way to accomplish this result is to form the support plate with a pair of extensions or prongs 130 extending outwardly along either side of the chord 128. These prongs 130 are then bent over the contact element 122 along the chord 128 to hold the contact element 122 intimately against the plate 124. A solder joint 132 is then advantageously applied between each prong 130 and the underlying portion of the contact element 122.

As in the first embodiment previously described, a resilient spring effect is provided in the contact element 122 by bending or sloping it outwardly from the attachment chord 128, so that the distance between the plate 124 and the contact element 122 gradually increases from the attachment chord 128 to the radius along which the protuberance 126 is formed. The bending or sloping may advantageously be performed, as previously described in connection with the first embodiment, when the protuberance 126 is formed, by an appropriate tool (not shown) applied to the contact element 122 through a radial slot 134 in the support plate.

In the contact assembly 120, the protuberance 126, with its multiplicity of radially-arrayed contact points 135 (one for each turn of wire), functions as a wiper for the resistive element in the potentiometer. The collector wiper function is provided by one or more collector contact elements that are attached to, or formed integrally with, the support plate 124 (thereby necessitating the electrical contact between the contact element 122 and the support plate 124, as mentioned above). Preferably, the collector contact elements are a pair of parallel fingers 136 formed integrally with the support plate 124 and extending from the periphery thereof, diametrically opposite the protuberance 126. The fingers 136 are bent radially inwardly over the spiral contact element 122, with the ends of the fingers spaced from the surface of the plate 124 and located substantially concentrically with the center of the plate so as to be surrounded by the spiral contact element 122. Preferably, the ends of the fingers 136 are outwardly radiused to form contact buttons 138, which are thus positioned to ride on, and conductively engage, the collector element of the potentiometer. The fingers 136 are thus cantilevered from the plate 124 to provide a resilient spring action at the contact buttons 138. Preferably, the contact buttons 138 are spaced from the surface of the plate 124 so as to be substantially coplanar with the protuberance 126. In practice, the specific geometry of the fingers 136 and the location and configuration of the contact buttons 138 will depend upon the geometry of the potentiometer elements, and particularly the collector element. It should be noted that a single finger 136 can be employed, but the use of two or more is preferred, to ensure good electrical contact with the collector element on the potentiometer substrate if dirt or dust gets between one contact button 138 and the collector element.

It should also be noted that this second preferred embodiment may be employed in a potentiometer of the so-called "hot shaft" design, previously described. In that case, the fingers 136 may be omitted.

The second preferred embodiment exhibits substantially the same advantages as does the first preferred embodiment: good contact resistance, good CRV and VRS characteristics, minimal chattering, and little or no "heel-and-toe" effect. Likewise, the benefits of a larger resistive element are obtained with this second embodiment, as may be discerned from FIGS. 12 and 14.

Figure 14:
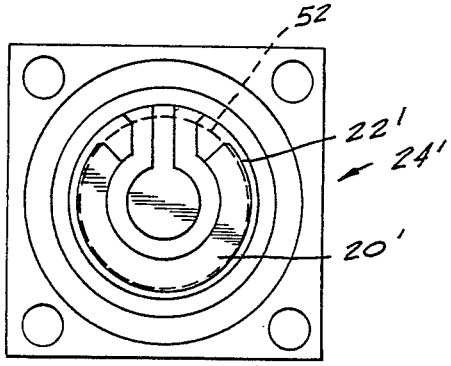
Figure 16:
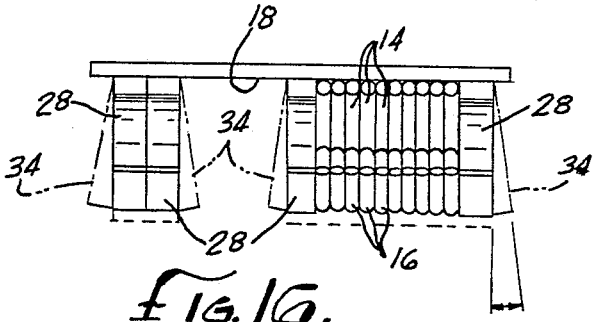
FIG. 16. PRIOR ART
FIG. 16 is an elevational view taken along line 16—16 of FIG. 15.
Figure 17A:
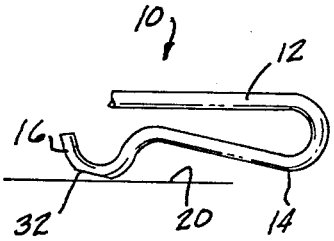
FIG. 17a. PRIOR ART
FIGS. 17*a*, 17*b*, and 17*c* are idealized and somewhat exaggerated elevational views of the prior art contact assembly of FIG. 15, illustrating the "heel-and-toe" effect discussed previously herein.
Figure 17B:
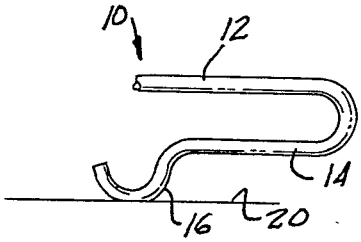
FIG. 17b. PRIOR ART
Figure 17C:
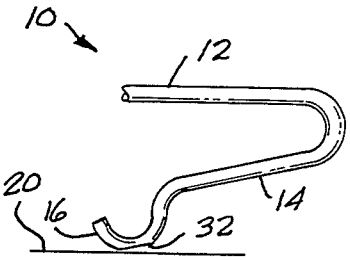
FIG. 17c. PRIOR ART

FIG. 14 has previously been referred to in connection with the prior art device of FIGS. 9, 10, and 11, but it also illustrates the geometry of a potentiometer that employs the contact assembly 120. Thus, the phantom outline designated by the numeral 52 can represent the periphery of the contact assembly 120. From FIG. 14, it can thus be seen that relatively little clearance on the substrate 22' is needed beyond the radius of the resistive element 20', thereby allowing the resistive element 20' to have a longer arc length than that of the resistive element 20 employed in the prior art device of FIG. 12.

The second preferred embodiment has a further advantage over the first preferred embodiment by virtue of the longer spring arm employed. In the first embodiment of FIGS. 3, 4, and 5, the contact element has a spring arm that extends through 90 degrees of arc, i.e., from an attachment radius 104 to a protuberance 106. In the contact assembly 120 of FIGS. 6, 7, and 8, the spring arm may extend through as much as about 120 degrees of arc, i.e., from an attachment prong 130 to the protuberance 126. The longer spring arm of the latter embodiment allows the use of conductive wire that has a lower spring rate. The lower spring rate, in turn, yields a lower likelihood of the contact element 120 taking a "set" when an axial load is applied to the rotor, with resulting degredation in the quality of the electrical contact when the load is removed or changed.

4. Conclusion

From the foregoing description, it can be seen that the present invention, in both of its preferred embodiments, eliminates the previously-described trade-off between compact size and good performance characteristics, by virtue of the annular geometry of the contact elements 82 and 122. Moreover, the use of a coiled spiral of fine gauge wire for these contact elements provides more individual contact points than can be provided with the stamped annular contact 40 of the prior art (shown in FIGS. 9, 10, and 11), thereby yielding improved contact resistance and CRV characteristics. Furthermore, the stability and VRS characteristics of the present invention show marked improvement as compared to prior art devices, due, at least in part, to the near elimination of chattering, heel-and-toe effects, and splaying.

Still another advantage of the present invention is that the attachment of the annular contact element to the support plate and to the rotor, as described above, Provides a better balanced loading on the rotor, as compared to cantilevered multi-wire contacts. The resultant reduction in the level of stress at the points of attachment lessens the likelihood of degraded performance or a failure due to such stresses.

The unique geometry of the present invention also provides a more even distribution of wear among the several contact points. Specifically, the radially outermost contact points, which travel a longer path along the resistive element have a lower spring rate than the radially innermost contact points, which travel a shorter path. Thus, the force applied by a contact point against the resistive element is inversely proportional to its path of travel, thereby allowing the contact points to wear fairly evenly, from the radially innermost to the radially outermost.

The above-described advantages are achieved with a contact that is easily and economically manufactured, and easily incorporated into existing potentiometer designs with relatively minor modifications to such devices.

Several modifications and variations of the preferred embodiments described herein may suggest themselves to those skilled in the pertinent arts. Some of these modifications and variations, for example, may contemplate the omission of a separate support plate, instead, attaching the annular contact element directly to the planar surface on the underside of the rotor. Alternatively, even if a separate support plate is used, the planar surface on the underside of the rotor might, in some instances, be considered a part of the support means for the annular contact element. Therefore, the term "support plate", as used herein, and in the claims which follow, should be interpreted as encompassing the planar surface on the underside of the rotor, where appropriate.

A number of other modifications and variations in the present invention have been described or suggested herein. These modifications, and others which may suggest themselves to those skilled in the pertinent arts, are considered within the spirit and scope of the present invention, as defined in the claims which follow.

What is claimed is:

1. A rotary-action variable resistor having a contact, said contact comprising: a length of conductor coiled into a substantially annular spiral with a protuberance along a selected radius thereof.

2. The contact of claim 1, wherein said spiral has a protuberance along each of a first pair of diametrically-opposed radii.

3. The contact of claim 1, further comprising a support plate having a substantially planar surface to which said spiral is fixedly mounted with said protuberance extending away from said planar surface.

4. The contact of claim 3, wherein said support plate is substantially circular, and wherein said spiral is substantially concentrically mounted thereon.

5. The contact of claim 2, further comprising a support plate having a substantially planar surface to which said spiral is fixedly mounted with said protuberances extending away from said planar surface.

6. The contact of claim 5, wherein said support plate is substantially circular, and wherein said spiral is eccentrically mounted thereon, with said protuberances substantially aligned along a diameter of said support plate, one of said protuberances extending radially close to the peripheral edge of said plate, the other of said protuberances having a portion that is at least approximately concentric with the center of said plate.

7. The contact of claim 3, wherein said spiral is mounted on said plate along a line defining a chord of said spiral, and wherein the distance between said plate and said spiral gradually increases from said chord to said protuberance.

8. The contact of claim 5, wherein said spiral is mounted on said plate along each of a second pair of diametrically-opposed radii that are displaced approximately 90 degrees from said first pair of diametrically-opposed radii, and wherein the distance between said plate and said spiral gradually increases from said second pair of radii to said first pair of radii.

9. A rotary-action variable resistor having a contact, said contact comprising:

supporting means having a substantially planar surface; and a length of conductive wire coiled into a substantially annular spiral fixedly mounted on said planar surface, said spiral having a protuberance along a selected radius thereof.

10. The contact of claim 9, wherein said support means includes a substantially circular support plate, and said spiral is mounted substantially concentrically on said plate.

11. The contact of claim 9, wherein said support means includes a substantially circular support plate, and said spiral is mounted eccentrically on said plate.

12. The contact of claim 11, wherein said spiral has a substantially linear protuberance along each of a first pair of diametrically-opposed radii.

13. The contact of claim 10, wherein said spiral is attached to said plate along a chord of said spiral that is substantially perpendicular to said selected radius, and wherein the distance between said plate and said spiral gradually increases from said chord to said selected radius.

14. The contact of claim 12, wherein said spiral is attached to said plate along a second pair of diametrically-opposed radii displaced approximately 90 degrees from said first pair of radii, and wherein the distance between said plate and said spiral gradually increases from said second pair of radii to said first pair of radii.

15. The contact of claim 14, wherein said spiral is attached to said plate by a pair of prongs formed integrally with said plate and bent over said spiral along each of said second pair of radii to hold said spiral against said plate.

16. The contact of claim 13, wherein said spiral is attached to said plate by a pair of prongs formed integrally with said plate and bent over said spiral along said chord to hold said spiral against said plate.

17. The contact of claim 16, wherein said protuberance forms a first wiper element, and wherein said contact further comprises a second wiper element spaced from, and substantially concentric with, the center of said plate.

18. The contact of claim 17, wherein said second wiper element comprises a finger extending from the peripheral edge of said plate and bent radially inwardly over said spiral so as to be spaced from said spiral and diametrically-opposed to said protuberance.

19. A rotary-action variable resistor having a contact, said contact comprising:

a substantially circular support plate having a substantially planar surface and a peripheral edge; and a substantially annular conductive element eccentrically mounted on said planar surface of said plate, said conductive element comprising a length of conductor coiled into a substantially annular spiral and having a pair of diametrically-opposed wiper elements spaced from said planar surface.

20. The contact of claim 19, wherein said conductive element includes a length of wire formed into said substantially annular spiral.

21. The contact of claim 19, wherein each of said wiper elements is a substantially linear protuberance extending radially across said conductive element.

22. The contact of claim 19, wherein said wiper elements are substantially aligned along a diameter of said support plate, one of said wiper elements extending radially adjacent to the peripheral edge of said plate, the other of said wiper elements having a portion that is at least approximately concentric with the center of said plate.

23. The contact of claim 22, wherein said conductive element is attached to said plate along each of a pair of diametrically-opposed radii that are displaced approximately 90 degrees from said wiper elements, and wherein the distance between said plate and said conductive element gradually increases from said diametrically-opposed radii to said wiper elements.

24. The contact of claim 23, wherein said plate includes a pair of prongs formed integrally therewith and bent over said conductive element along said diametrically-opposed radii to hold said conductive element against said planar surface.

25. A rotary-action variable resistor having a contact, said contact comprising:

a support plate having a substantially circular, planar surface and a peripheral edge; and a substantially annular conductive element substantially concentrically mounted on said planar surface of said plate, said conductive element comprising a length of conductor coiled into a substantially annular spiral and having a wiper element extending along a selected radius thereof.

26. The contact of claim 25, wherein said conductive element includes a length of wire formed into said substantially annular spiral.

27. The contact of claim 25, wherein said wiper element is a substantially linear protuberance extending radially across said conductive element.

28. The contact of claim 26, wherein said conductive element is attached to said plate along a line defining a chord of said circular planar surface, said chord being substantially perpendicular to said linear protuberance and circumferentially displaced therefrom by at least approximately 90 degrees.

29. The contact of claim 28, wherein the distance between said plate and said conductive element gradually increases from said chord to said protuberance.

30. The contact of claim 29, wherein said plate comprises:

a pair of prongs formed integrally therewith and bent over said conductive element along said chord to hold said conductive element against said plate.

31. The contact of claim 25, wherein said wiper element is a first wiper element, and further comprising a second wiper element disposed substantially concentrically with the center of said plate so as to be circumferentially surrounded by said conductive element.

32. The contact of claim 31, wherein said second wiper element comprises a finger extending from the peripheral edge of said plate and bent radially inwardly over said conductive element so as to be spaced therefrom and diametrically-opposed to said first wiper element.

* * * * *